US010236143B1

(12) United States Patent
Chang et al.

(10) Patent No.: US 10,236,143 B1
(45) Date of Patent: Mar. 19, 2019

(54) OPERATION MECHANISM FOR ELECTRONIC DEVICE

(71) Applicant: Quanta Computer Inc., Taoyuan (TW)

(72) Inventors: Jung-Wen Chang, Taoyuan (TW); Wan-Chi Lin, Taoyuan (TW); Bo-Chun Hsu, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 15/863,632

(22) Filed: Jan. 5, 2018

(30) Foreign Application Priority Data

Sep. 14, 2017 (TW) ..... 106213668 U

(51) Int. Cl.

| | |
|---|---|
| ***H01H 19/14*** | (2006.01) |
| ***H01H 19/04*** | (2006.01) |
| ***H01H 19/08*** | (2006.01) |
| ***H01H 19/46*** | (2006.01) |

(52) U.S. Cl.
CPC ..... *H01H 19/14* (2013.01); *H01H 19/04* (2013.01); *H01H 19/08* (2013.01); *H01H 19/46* (2013.01)

(58) Field of Classification Search
CPC ..... H01H 19/14; H01H 19/08; H01H 19/04; H01H 19/46
USPC ..... 200/336, 564, 570, 571, 241, 242, 252, 200/253, 11 R, 11 TW
See application file for complete search history.

(56) References Cited

U.S. PATENT DOCUMENTS

| | | | | |
|---|---|---|---|---|
| 4,016,387 A * | 4/1977 | Aberer | H01H 19/10 200/11 R |
| 2007/0246332 A1* | 10/2007 | Su | H01H 19/14 200/11 R |
| 2015/0221461 A1* | 8/2015 | Man | G03B 15/05 200/564 |

* cited by examiner

*Primary Examiner* — Edwin A. Leon
*Assistant Examiner* — Lheiren Mae A Caroc
(74) *Attorney, Agent, or Firm* — McClure, Qualey & Rodack, LLP

(57) ABSTRACT

An operation mechanism is provided, including a fixed ring and a rotating assembly, wherein the rotating assembly is rotatably connected to the fixed ring. The rotating assembly includes a rotating ring and a movable portion. The rotating ring connects to the fixed ring. The rotating ring and the movable portion are fixed to each other. The movable portion is disposed on a surface of the fixed ring and configured to contact a circuit board disposed on the surface. When the rotating assembly is rotated from a first position to a second position relative to the fixed ring, the movable portion moves from a first contact position to a second contact position relative to the circuit board.

6 Claims, 11 Drawing Sheets

OPERATION MECHANISM FOR ELECTRONIC DEVICE

CROSS REFERENCE TO RELATED APPLICATIONS

This application claims the benefit of Taiwan Patent Application No. 106213668, filed on Sep. 14, 2017, the entirety of which is incorporated by reference herein.

BACKGROUND OF THE INVENTION

Field of the Invention

The application relates in general to an operation mechanism for an electronic device, and in particular to an operation mechanism that includes a rotating assembly.

Description of the Related Art

With the development of science and technology, electronic products are progressing day by day, such as digital video cameras, panoramic cameras and virtual reality (VR) cameras. They bring a rich visual experience to people. In general, there are many buttons on the surface of the housing of an electronic product for users to operate. However, these buttons only have one operation instruction (for example, selection, confirmation, etc.), so that the electronic product must have a plurality of buttons, and the configuration of the integrated module buttons cannot easily be adjusted and the feedback touch also not easily to adjust. In addition, some users find that these protruding buttons detract from the aesthetic appearance of the device. Nowadays, it has become a trend to offer products with versatility, beauty, small size, and simple operation. Therefore, it is important to design an electronic product that the user feels convenient, simple, comfortable, and visually aesthetic.

BRIEF SUMMARY OF INVENTION

To address the deficiencies of conventional products, an embodiment of the invention provides an operation mechanism, including a fixed ring and a rotating assembly, wherein the rotating assembly is rotatably connected to the fixed ring. The rotating assembly includes a rotating ring and a movable portion. The rotating ring connects to the fixed ring. The rotating ring and the movable portion are fixed to each other. The movable portion is disposed on a surface of the fixed ring and configured to contact a circuit board disposed on the surface. When the rotating assembly is rotated from a first position to a second position relative to the fixed ring, the movable portion moves from a first contact position to a second contact position relative to the circuit board.

In some embodiments, the operation mechanism further comprises a positioning member, and the movable assembly includes a sheet element having a plurality of through holes, wherein the positioning member is disposed on the surface of the fixed ring and extended through one of the through holes, and when the movable portion moves from the first position to the second position, the positioning member is extended through another one of the through holes.

In some embodiments, the surface of the fixed ring is formed with a recess configured to receive the positioning member.

In some embodiments, the rotating ring and the movable portion are respectively located at two opposite sides of the fixed ring.

In some embodiments, the operation mechanism further comprises a front housing fixed to the fixed ring, and the rotating assembly is rotatably disposed between the front housing and the fixed ring.

In some embodiments, the movable portion has a plurality of sheet elements which are separated from each other, and the sheet elements are disposed on the surface of the fixed ring.

In some embodiments, the operation mechanism further comprises a positioning member, and the movable portion has a first sheet element, a second sheet element, and a third sheet element which are disposed on the surface of the fixed ring and around the central axis of the fixed ring, wherein the second sheet element disposed between the first and third sheet elements has a plurality of through holes, and the positioning member passes through one of the through holes. When the movable portion moves from the first position to second position, the first sheet element moves from the first contact area to the second contact area, and the position member passes through another one of the through holes.

In some embodiments, the rotating ring is formed with a connecting portion, the movable portion includes a sheet element, and the connecting portion passes through the fixed ring and connects to the sheet element.

In some embodiments, the fixed ring has a through slot, and the connecting portion extends through the through slot, and when the rotating assembly rotates relative to the fixed ring, the connecting portion moves within the through slot.

In some embodiments, the two ends of the through slot are formed with a tapered structure, and the connecting portion has an amplification structure, and when the rotating assembly rotates to an end position relative to the fixed ring, the amplification structure engages with the tapered structure.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The making and using of the embodiments of the operation mechanisms are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Unless defined otherwise, all technical and scientific terms used herein have the same meaning as commonly understood to one of ordinary skill in the art to which this invention belongs. It should be appreciated that each term, which is defined in a commonly used dictionary, should be interpreted as having a meaning conforming to the relative skills and the background or the context of the present disclosure, and should not be interpreted by an idealized or overly formal manner unless defined otherwise.

Figure 1:
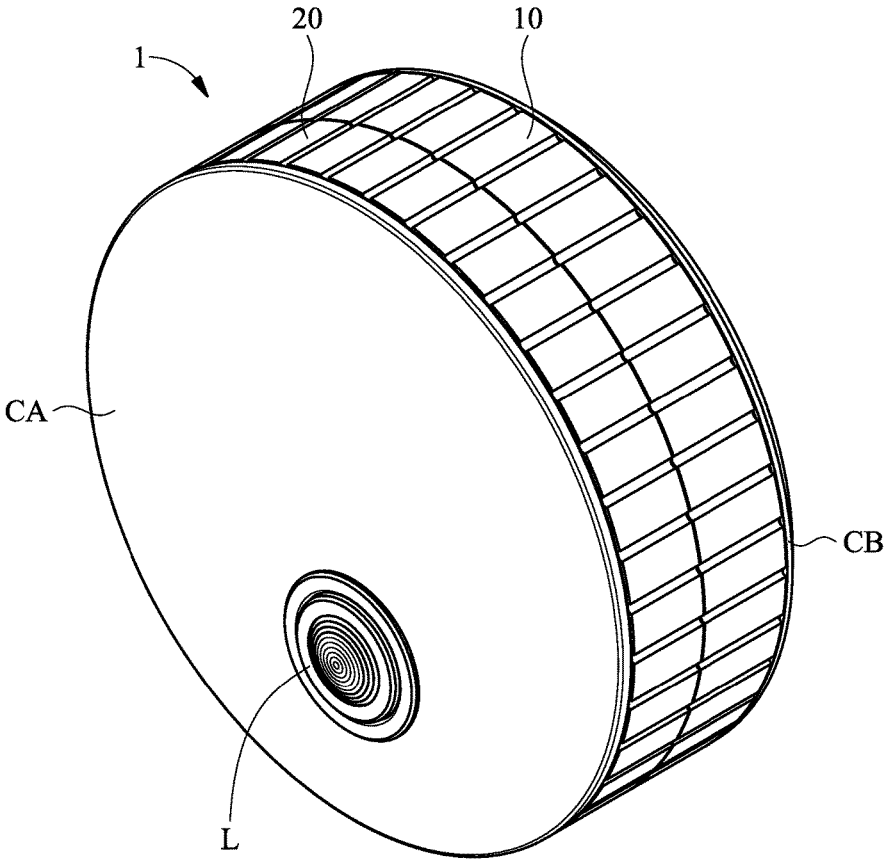
FIG. 1 is a schematic diagram of an operation mechanism with a lens module as an electronic device according to an embodiment of the invention.

FIG. 1 is a schematic diagram of an operation mechanism 1 according to an embodiment of the invention. The operation mechanism 1 may be disposed in an electronic device (such as a camera device), and a user can control or operate the electronic device via the operation mechanism 1, for example, switching the shooting/recoding mode or adjusting the focus of the camera lens. As shown in FIG. 1, a lens module L is disposed on the operation mechanism 1, which can be used as an electronic product (such as a camera device). By the operation mechanism 1, the user can easily and conveniently operate the electronic device (e.g. switching the camera mode). It should be noted that the aforementioned lens module L can be replaced by other circuit modules/electronic units in the electronic device, which is not limited. The details of the operation mechanism 1 will be described in detail below.

Figure 2:
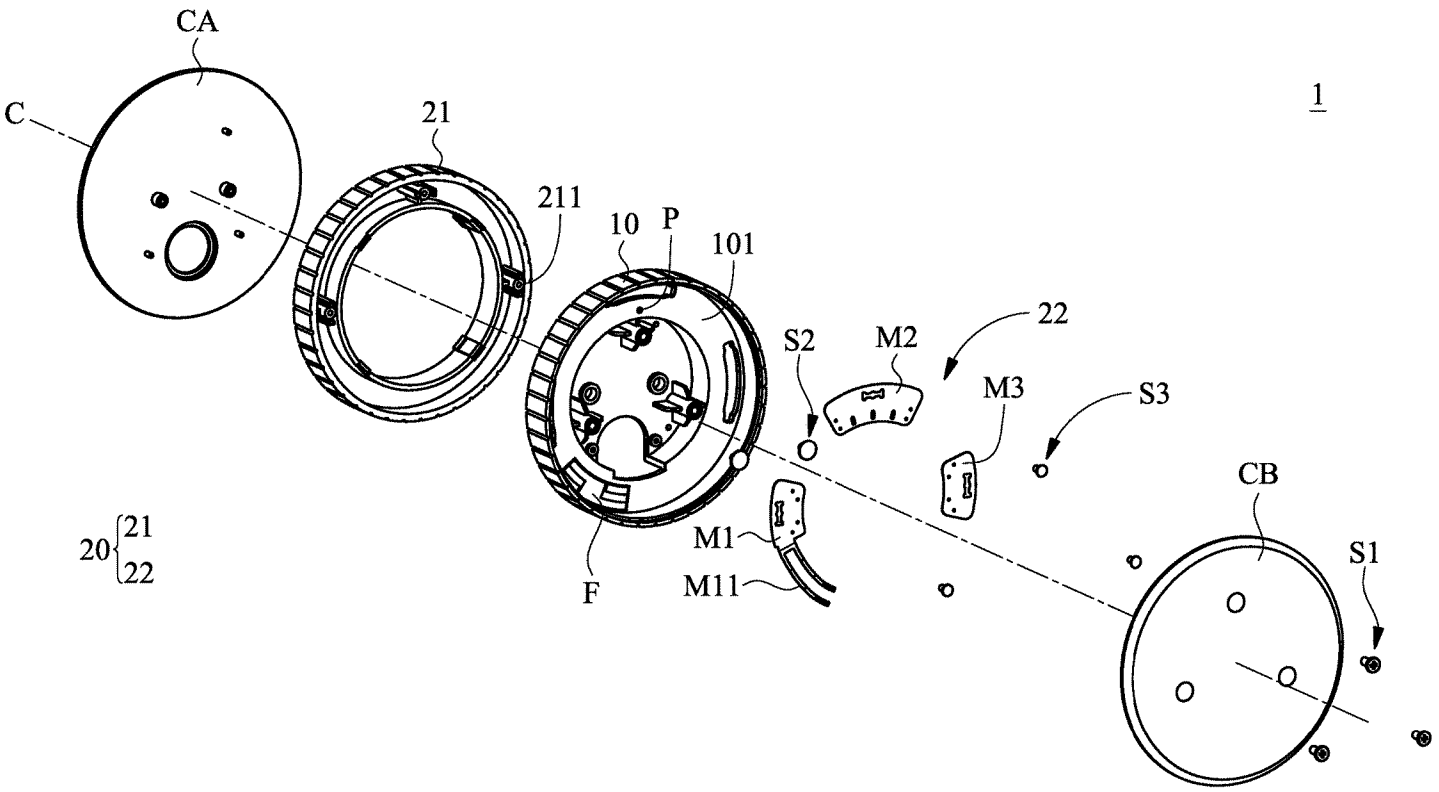
FIG. 2 is an exploded diagram of the operation mechanism in FIG. 1.

Please refer to FIGS. 1 and 2, wherein FIG. 2 is an exploded-view diagram of the operation mechanism 1 in FIG. 1. The operation mechanism 1 primarily comprises a front casing CA, a rear casing CB, a fixed ring 10, and a rotating assembly 20. The front and rear casings CA and CB are configured to protect the fixed ring 10 and the rotating assembly 20, and they can be used as a decorative housing. The fixed ring 10 and the rotating assembly 20 are disposed between the front and rear casings CA and CB, and the rotating assembly 20 is disposed between the fixed ring 10 and the front casing CA, wherein the fixed ring 10 is fixed to the rear casing CB via a plurality of fasteners (such as screws) S1 and fixed to the front casing CA via a plurality of fasteners (such as screws) S2. Furthermore, the rotating assembly 20 can be rotated (is rotatable) with respect to the fixed ring 10, front casing CA, and the rear casing CB. By rotating the rotation assembly 20, an electronic device can be operated.

Figure 3A:
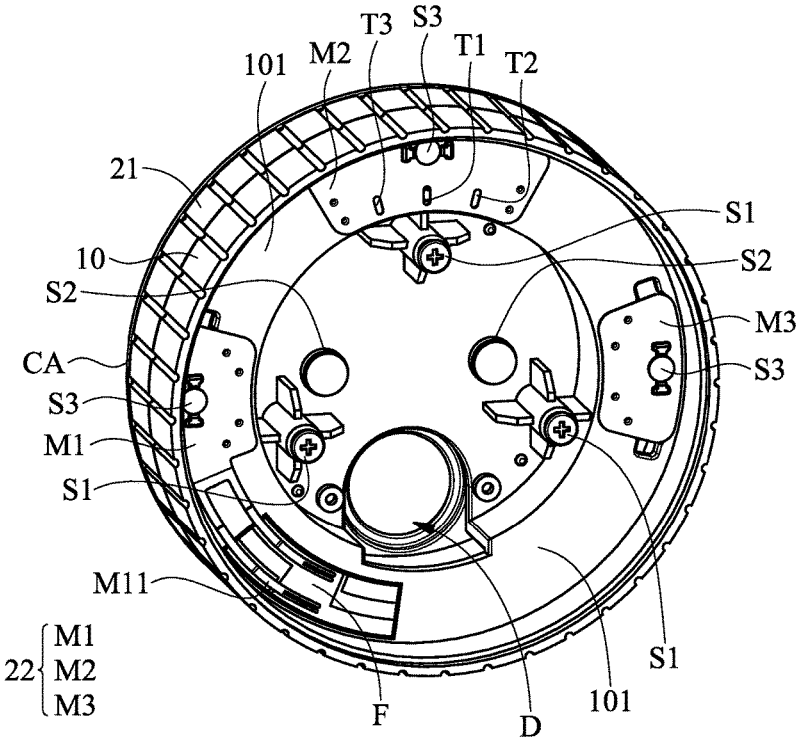
FIG. 3A is a schematic diagram of the operation mechanism in FIG. 1 after assembly (the rear casing is omitted).

In particular, please refer to FIGS. 2 and 3A, wherein FIG. 3A shows a schematic diagram of the operation mechanism 1 in FIG. 2 after assembly (the rear casing CB is omitted). The rotating assembly 20 includes a rotating ring 21, a movable portion 22, and a plurality of fasteners (such as screws) S3. It can be seen from FIG. 3A that the rotating ring 21 is sandwiched between the fixed ring 10 and the front casing CA, and the movable portion 22 is connected to and disposed on a surface 101 of the fixed ring 10. The movable portion 22 is pressed by the fasteners S3 against the fixed ring 10, and the movable portion 22 and the rotating ring 21 are disposed on opposite sides of the fixed ring 10. A circuit board F, such as a flexible printed circuit board (FPCB), is disposed on the surface 101 of the fixed ring 10 and electrically connected to the lens module L (FIG. 1) through one or more wires (not shown), and the movable portion 22 (has metal material) is configured to be in contact with this circuit board F.

Figure 3B:
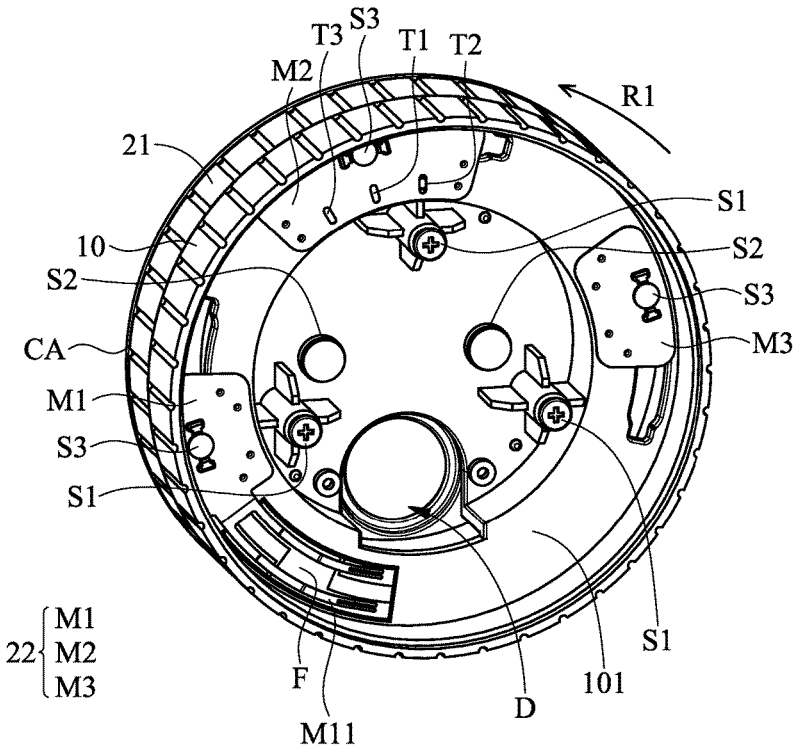
FIGS. 3B to 3C are schematic diagrams of the rotating assembly rotating relative to the fixed ring and the front casing.
Figure 3C:
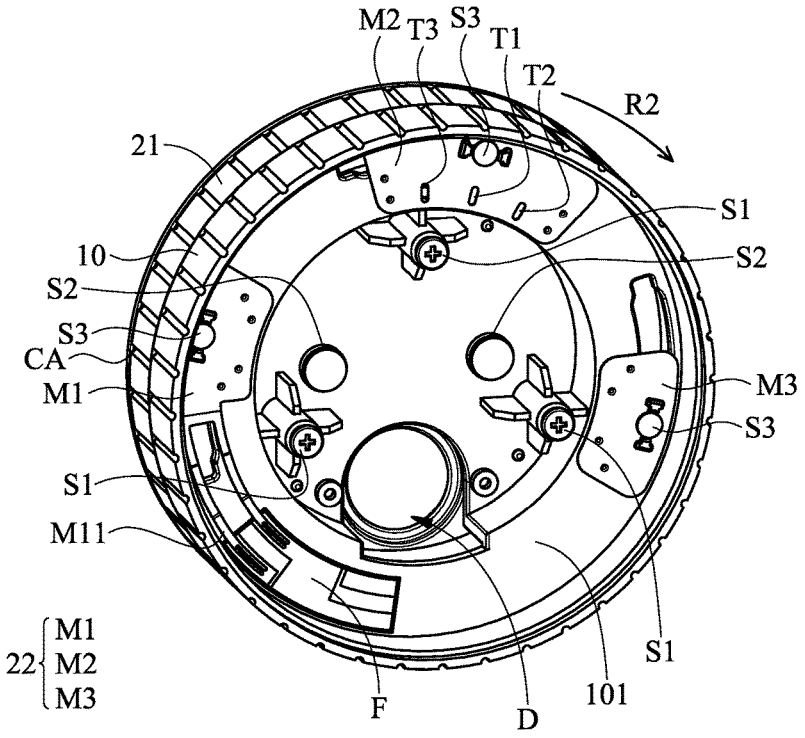
Figure 4A:
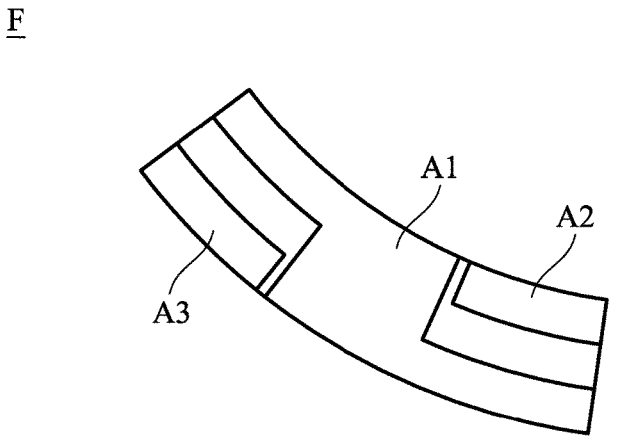
FIG. 4A is a schematic diagram of the circuit board F which is defined with a plurality of contact areas A1, A2 and A3.
Figure 6:
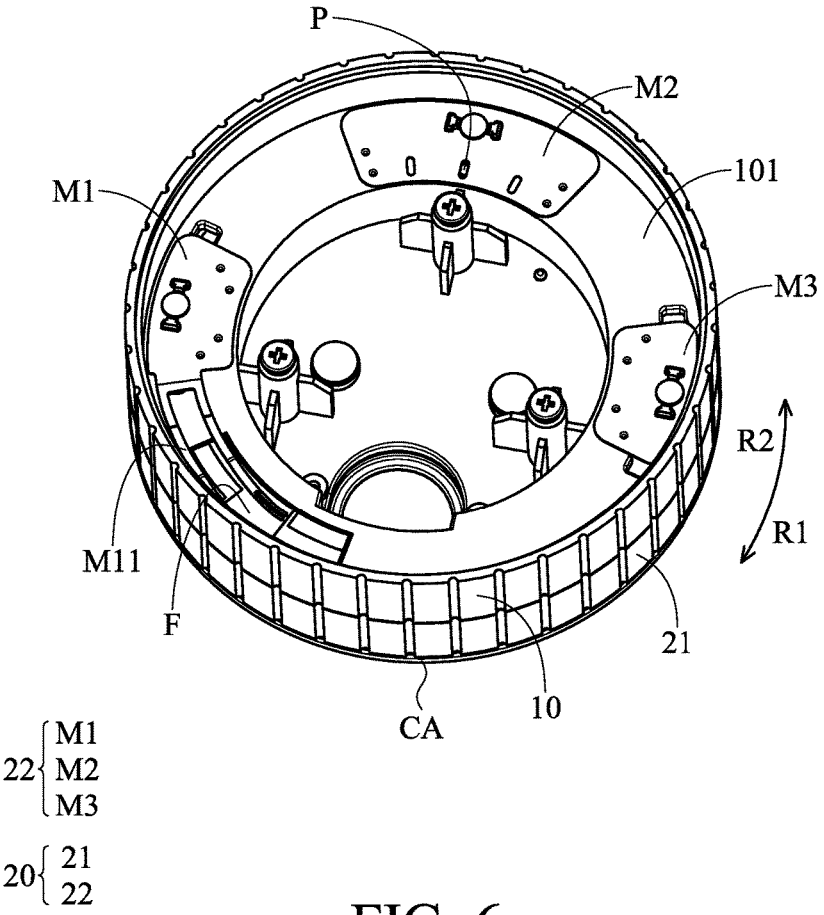
FIG. 6 is a schematic diagram of the rotating assembly being rotatable in directions R1 and R2 relative to the fixed ring and the front casing (different perspective).

By the rotation of the rotating assembly 20, the relative position of the movable portion 22 and circuit board F will be changed (the rotating assembly 20 moves with respect to the circuit board F) so that the rotating assembly 20 will be in contact with the different area of the circuit board F. Specifically, the movable portion 22 includes a first sheet element M1, a second sheet element M2, and a third sheet element M3. The first sheet element M1 has an extending structure M11. When the rotating assembly 20 rotates relative to the fixed ring 10, as shown in FIG. 3B (in direction R1), the movable portion 22 disposed on the surface 101 of the fixed ring 10 moves relative to the circuit board F from a first position (FIG. 3A) to a second position (FIG. 3B). In other words, the first sheet element M1 would contact different areas of the circuit board F. Referring to FIG. 4A, there are a plurality of "contact areas" on the circuit board F: the first contact area A1, the second contact area A2, and the third contact area A3. When the extending structure M11 (having metal material) of the first sheet element M1 touches (or is in contact with) different contact areas (i.e. when in the first position (FIG. 3A), only the first contact area A1 is touched; when in the second position (FIG. 3B), both the first contact area A1 and the second contact area A2 are touched), the circuit board F transmits different signals to the lens module L (the signal may be, for example, a signal for switching the shooting mode in the electronic device or a signal for adjusting the long shot/close up, or a signal for other selection instructions). Therefore, the user can easily operate the electronic device by rotating the operation mechanism 1. FIG. 6 shows that the rotating assembly 20 can be rotated in the direction R1 or in the opposite direction R2 (in other perspective). In an embodiment, the first sheet element M1 is in contact with/touches only the first contact area A1 (FIG. 3A), and the circuit board F transmits a first signal. In an embodiment, the first sheet element M1 simultaneously is in contact with (touches) the first contact area A1 and the second contact area A2 (FIG. 3B), and the circuit board F transmits a second signal. In an embodiment, the first sheet element M1 simultaneously is in contact with/touches the first contact area A1 and the third contact area A3 (FIG. 3C), and the circuit board F transmits a third signal.

Figure 4B:
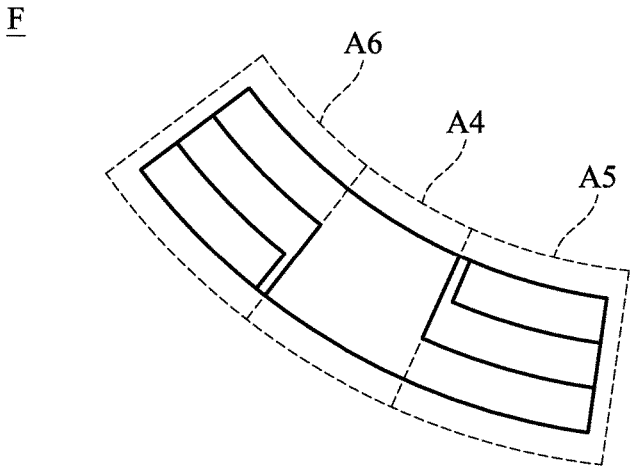
FIG. 4B is a schematic diagram of the circuit board F which is defined with a plurality of contact areas A4, A5 and A6.

In some embodiments, the plurality of contact areas of the circuit board F may also be defined as the first, second and third contact areas A4, A5 and A6, as shown in FIG. 4B. When the movable portion 22 in the first position (FIG. 3A), the first contact area A4 is touched by the movable portion 22 and the circuit board F transmits a first signal. When the movable portion 22 is in the second position (FIG. 3B), the first contact area A5 is touched and the circuit board F transmits a second signal. When the movable portion 22 is in the third position (FIG. 3C), the third contact area A6 is touched and the circuit board F transmits a third signal.

It should be noted that, in the present embodiment, the movable portion 22 has three sheet elements (M1, M2 and M3) which are arranged around the central axis C (FIG. 2) of the fixed ring 10 and disposed on the surface 101, wherein those sheet elements (M1, M2 and M3) are arranged in a separated manner (i.e. there are gaps formed between the adjacent sheet elements). With this configuration, the weight of the movable portion 22 can be dispersed, so that the rotation mechanism 1 can be more balanced, whereby a user can easily and comfortably operate it.

Figure 5A:
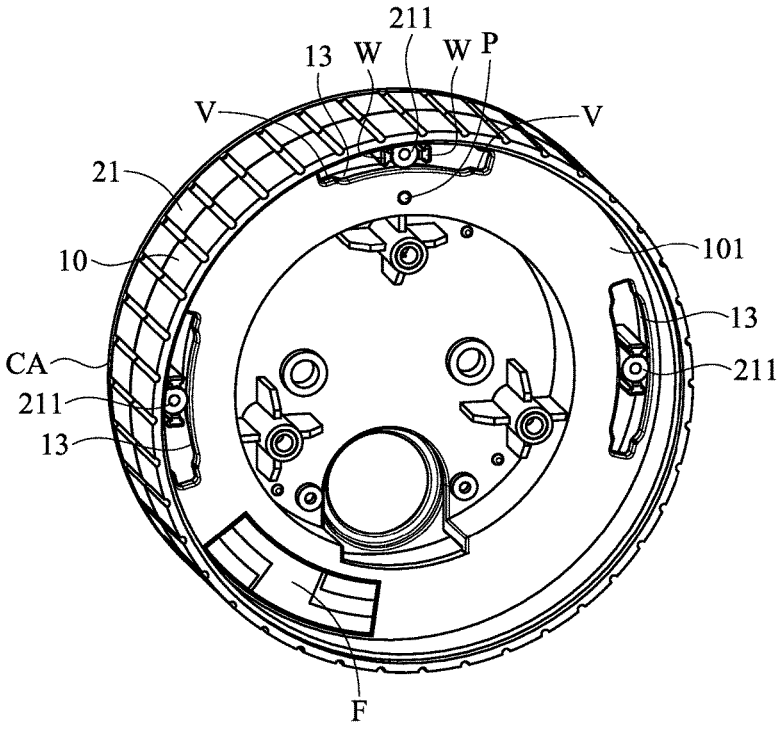
FIGS. 5A to 5C are schematic diagrams of omitting the movable portion 22 and the fasteners S1, S2, and S3 in FIGS. 3A to 3C to clearly see a plurality of connecting portions 211 and through slots 13.
Figure 5B:
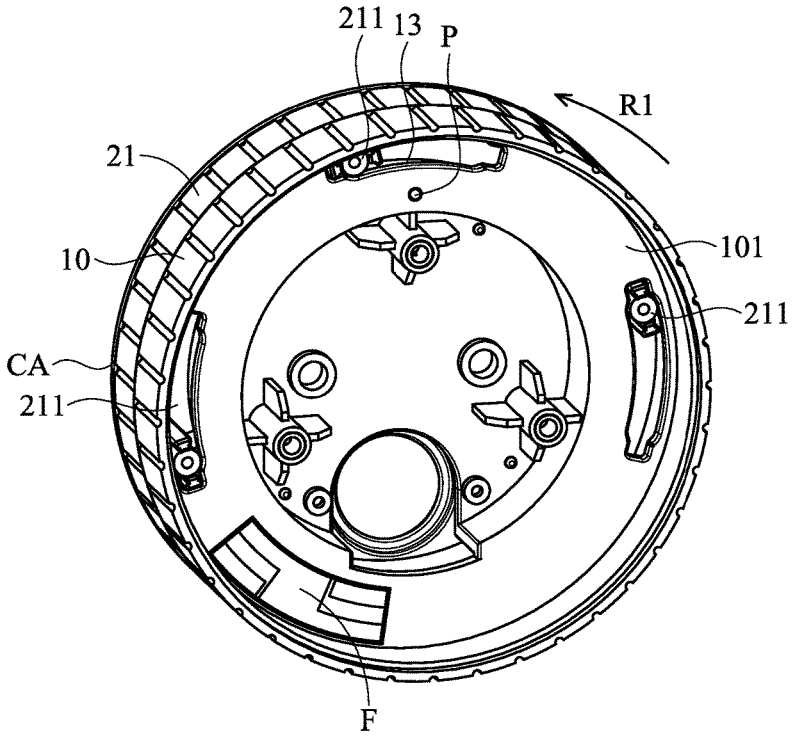

FIGS. 5A to 5B illustrate schematic views of the movable portion 22 and the fasteners S1, S2, and S3 omitted in FIGS. 3A-3B to clearly show a plurality of connecting portions 211 and through slots 13. The rotating ring 21 is formed with the plurality of connecting portions 211 which extend toward the fixed ring 10 and pass (extend) through the plurality of through slots 13 of the fixed ring 10, and corresponding to the first, second, and third sheet elements M1, M2, and M3 (FIGS. 2 and 3A). The connecting portions 211 also pass through the first, second and third sheet elements M1, M2 and M3 and engage with them (i.e., the sheet elements M1, M2 and M3 mounted around the connecting portions 211). Then, those sheet elements are pressed onto the surface 101 through the aforementioned fastener S3 to prevent these sheet elements from falling off the connecting portions 211. When the rotating assembly 20 is rotated, as shown in FIGS. 3A-3B, 5A-5B, and 7, each connecting portion 211 of the rotating ring 21 can move within each through slot 13 and can be restricted (limited) by the two ends of the through slot 13, so that the range of movement of each connecting portion 211 is limited.

It should be noted that both ends of the through slot 13 have a tapered structure V, and both ends of the connecting portion 211 have an amplification structure W. When the rotating assembly 20 rotates relative to the fixed ring 10 to an end position, (as shown in FIGS. 3B and 5B), the amplification structure W engages with the tapered structure V, so that the rotating ring 21 in the second position can be stably engaged with the fixed ring 10 to avoid or reduce the swinging or shaking that occurs, thereby providing a good operating experience.

Figure 7:
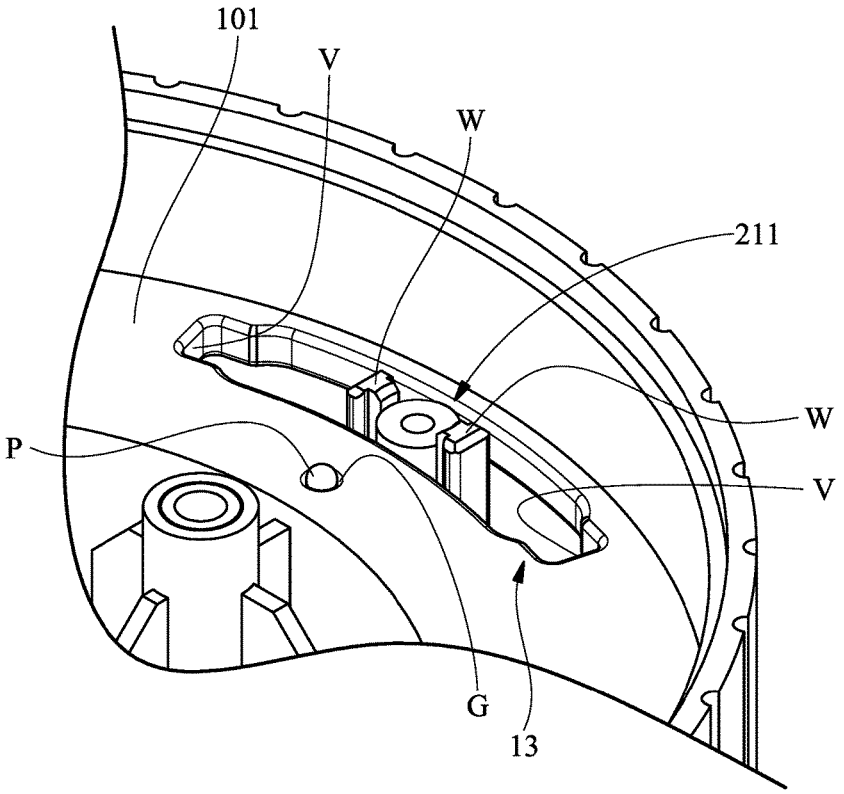
FIG. 7 is a schematic diagram of the connection portion 211 of the rotating ring disposed in the through slot 13 of the fixed ring and the positioning member P is disposed on the recess G of the surface 101.

In addition, as shown in FIGS. 2 and 7, the rotating mechanism 1 further comprises a positioning member P (for example, is a rolling ball) disposed on a recess G of the surface 101. In this embodiment, the recess G is configured to receive the positioning member P, and about one-third of the volume the positioning member P is disposed in the recess G. The second sheet element M2 of the movable portion 22 has a plurality of through holes T1, T2 and T3. When the rotating assembly 20 is at (in) the first position (FIGS. 3A and 5A), the positioning member P passes through the through hole T2 to engage with the second sheet element M2; when the rotating assembly 20 rotates from the first position to the second position (FIGS. 3B and 5B), since the second sheet element M2 of the rotating assembly 20 is rotated relative to the fixing ring 10, the positioning member P is changed from passing through the through hole T1 to passing through the through hole T2 and engages with the second sheet element M2. In this way, when the user rotates the operation mechanism 1 for signal switching, a feedback touch is generated through the engagement between the positioning member P and the through holes T1, T2 and T3, so that the user can know that the rotating assembly 20 has rotated to reach a correct position, to increase operational convenience.

Figure 5C:
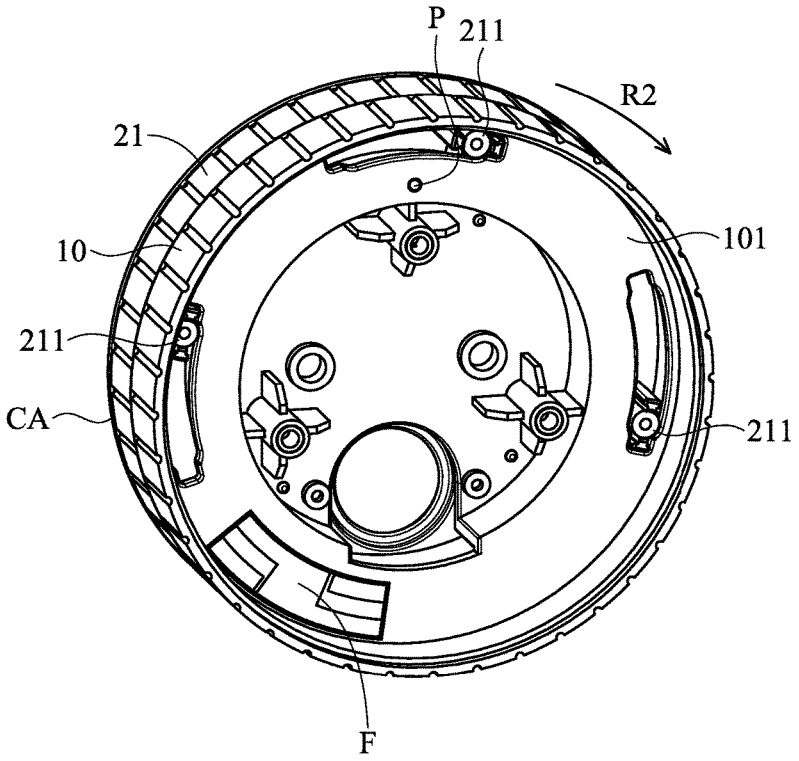

Furthermore, the user may also rotate the rotating assembly 20 in the direction R2 (opposite to the direction R1) to move it from the second position to the first position (as shown in FIGS. 3B-3A), so that the first sheet element M1 returns to only in contact with the first contact area A1. The rotating assembly 20 can be further rotated in the R2 direction to reach the third position (as shown in FIGS. 3C and 5C), so that the first sheet element M1 contacts the first contact area A1 and the third contact area A3, and the positioning member P is located in the through hole T3.

In another embodiment, the circuit board F may be provided with more contact areas for the first sheet element M1 to touch to transmit more different signals to the lens module L. The second sheet element M2 may also be provided more through holes for the positioning member P to engage, so that the operation mechanism 1 can have more switching operation functions.

In another embodiment, the movable portion 22 may also include only one sheet element. The sheet element has an extending structure M11 for being in contact with different contact areas of the circuit board F, and is formed with a plurality of through holes T1. T2 and T3, for the positioning member P disposed therein to engage with the sheet element.

In summary, an operation mechanism is provided, comprising a fixed ring and a rotating assembly, wherein the rotating assembly is rotatably connected to the fixed ring. The rotating assembly includes a rotating ring and a movable portion. The rotating ring connects to the fixed ring. The rotating ring and the movable portion are fixed to each other. The movable portion is disposed on a surface of the fixed ring and configured to contact a circuit board disposed on the surface. When the rotating assembly is rotated from a first position to a second position relative to the fixed ring, the movable portion moves from a first contact position to a second contact position relative to the circuit board. Therefore, by rotating the rotating assembly, the position where the movable portion contacts the circuit board can be changed to transmit different signals, for example, transmitting a signal to a lens module (or other circuit module) to switch the shooting mode, thereby the electronic device can be easily operated. In this way, it is not necessary to provide a physical button protruding from the housing of the electronic device, so as to improve the aesthetics and to improve the usability by operating in a rotating manner. In addition, the operation mechanism further comprises a positioning member engaging with the through hole of the movable portion. When the rotating assembly rotates from the first position to the second position, the positioning member engages with the other one through hole. The engagement of the positioning member and the through hole provides a feedback touch so that the user has a good user experience.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. An operation mechanism, disposed in an electronic device, comprising:

a fixed ring;

a rotating assembly, rotatably connected to the fixed ring, including:

a rotating ring, connected to the fixed ring; and a movable portion, wherein the rotating ring and the movable portion are fixed to each other, and the movable portion is disposed on a surface of the fixed ring and configured to be in contact with a circuit board disposed on the fixed ring;

wherein when the rotating assembly is rotated from a first position to a second position relative to the fixed ring, the movable portion moves from a first contact area to a second contact area relative to the circuit board;

wherein the movable portion has a plurality of sheet elements which are separated from each other, and the sheet elements are disposed on the surface of the fixed ring; and a positioning member, and the movable portion has a first sheet element, a second sheet element, and a third sheet element which are disposed on the surface of the fixed ring and around the central axis of the fixed ring, wherein the second sheet element disposed between the first and third sheet elements has a plurality of through holes, and the positioning member passes through one of the through holes;

wherein when the movable portion moves from the first position to second position, the first sheet element moves from the first contact area to the second contact area, and the positioning member passes through another one of the through holes.

2. The operation mechanism as claimed in claim 1, wherein the positioning member is disposed on the surface of the fixed ring and passes through one of the through holes.

3. The operation mechanism as claimed in claim 2, wherein the surface of the fixed ring is formed with a recess configured to receive the positioning member.

4. The operation mechanism as claimed in claim 1, wherein the rotating ring and the movable portion are respectively located at two opposite sides of the fixed ring.

5. The operation mechanism as claimed in claim 1, further comprising a front housing fixed to the fixed ring, and the rotating assembly is rotatably disposed between the front housing and the fixed ring.

6. An operation mechanism, disposed in an electronic device, comprising:

a fixed ring; and a rotating assembly, rotatably connected to the fixed ring, including:

a rotating ring, connected to the fixed ring; and a movable portion, wherein the rotating ring and the movable portion are fixed to each other, and the movable portion is disposed on a surface of the fixed ring and configured to be in contact with a circuit board disposed on the fixed ring;

wherein when the rotating assembly is rotated from a first position to a second position relative to the fixed ring, the movable portion moves from a first contact area to a second contact area relative to the circuit board;

wherein the rotating ring is formed with a connecting portion, the movable portion includes a sheet element, and the connecting portion passes through the fixed ring and connects to the sheet element;

wherein the fixed ring has a through slot, and the connecting portion extends through the through slot, and when the rotating assembly rotates relative to the fixed ring, the connecting portion moves within the through slot;

wherein two ends of the through slot are formed with a tapered structure, and the connecting portion has an amplification structure, and when the rotating assembly rotates to an end position relative to the fixed ring, the amplification structure engages with the tapered structure.

* * * * *